US010009991B2

(12) United States Patent
Nishisaka et al.

(10) Patent No.: US 10,009,991 B2
(45) Date of Patent: Jun. 26, 2018

(54) TARGET SUPPLY APPARATUS AND EUV LIGHT GENERATING APPARATUS

(71) Applicant: GIGAPHOTON INC., Tochigi (JP)

(72) Inventors: Toshihiro Nishisaka, Oyama (JP); Yoshiaki Kato, Oyama (JP); Fumio Iwamoto, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days. days.

(21) Appl. No.: 15/019,577

(22) Filed: Feb. 9, 2016

(65) Prior Publication Data

US 2016/0165708 A1 Jun. 9, 2016

Related U.S. Application Data

(63) Continuation of application No. PCT/JP2013/075036, filed on Sep. 17, 2013.

(51) Int. Cl.
*H05G 2/00* (2006.01)

(52) U.S. Cl.
CPC ..... *H05G 2/006* (2013.01); *H05G 2/008* (2013.01); *H05G 2/005* (2013.01)

(58) Field of Classification Search
CPC ..... B41J 2/04; B41J 2/045; H05G 2/006
See application file for complete search history.

(56) References Cited

U.S. PATENT DOCUMENTS 2,711,756 A * 6/1955 Cottone ..... F24H 9/124 137/592
3,177,669 A * 4/1965 Sikes ..... H02G 1/06 37/466
4,134,174 A * 1/1979 Flynn ..... E03F 9/00 134/104.4
5,757,391 A * 5/1998 Hoisington ..... B41J 2/04 347/11
6,336,660 B1 * 1/2002 Katsuda ..... B60R 21/2644 280/236

(Continued)

FOREIGN PATENT DOCUMENTS

JP 2005-268461 A 9/2005
JP 2010-166041 A 7/2010

(Continued)

OTHER PUBLICATIONS

International Search Report; PCT/JP2013/075036; dated Nov. 26, 2013.

(Continued)

*Primary Examiner* — Jason McCormack
*Assistant Examiner* — Sean Luck
(74) *Attorney, Agent, or Firm* — Studebaker & Brackett PC

(57) ABSTRACT

A target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes a gas flow path penetrating the second end portion of the tank and configured to guide the inert gas in a direction toward an inner wall of the main body.

14 Claims, 8 Drawing Sheets

(56) References Cited

U.S. PATENT DOCUMENTS

2003/0118718 A1* 6/2003 Hilson ..... B01J 19/0046 427/2.11
2005/0221137 A1* 10/2005 Bandhauer ..... F01K 3/26 429/413
2006/0021640 A1* 2/2006 Chu ..... B08B 9/0325 134/110
2006/0145022 A1* 7/2006 Buehler ..... B64G 1/402 244/172.2
2006/0192153 A1 8/2006 Bykanov et al.
2006/0192154 A1 8/2006 Algots et al.
2006/0192155 A1 8/2006 Algots et al.
2006/0213514 A1* 9/2006 Price ..... A61M 15/0028 128/203.15
2006/0273483 A1* 12/2006 Vakili ..... D01D 5/092 264/103
2008/0072609 A1* 3/2008 Ikeuchi ..... B01J 19/06 62/54.1
2008/0283776 A1 11/2008 Algots et al.
2009/0320559 A1* 12/2009 Lemieuvre ..... G01N 1/22 73/23.34
2010/0193055 A1* 8/2010 Ishii ..... B41J 2/16523 137/582
2010/0202949 A1* 8/2010 Valente ..... B01D 53/14 423/246
2010/0258747 A1 10/2010 Vaschenko et al.
2010/0282987 A1 11/2010 Hergenhan et al.
2011/0215048 A1* 9/2011 Phillips ..... A01K 7/02 210/501
2012/0050704 A1* 3/2012 Levesque ..... G03F 7/70033 355/53
2012/0280148 A1* 11/2012 Loopstra ..... H05G 2/003 250/492.1
2012/0292527 A1 11/2012 Fomenkov et al.
2013/0075625 A1 3/2013 Yabu et al.
2013/0186976 A1* 7/2013 Ishihara ..... B05B 17/06 239/102.1
2013/0209077 A1 8/2013 Yabu et al.

FOREIGN PATENT DOCUMENTS

JP 2010-263210 A 11/2010
JP 2012-138364 A 7/2012
JP 2013-073733 A 4/2013
JP 2013-179029 A 9/2013

OTHER PUBLICATIONS

An Office Action, "Notification of Reasons for Refusal", issued by the Japanese Patent Office dated Sep. 6, 2017, which corresponds to Japanese Patent Application No. 2015-537447 and is related to U.S. Appl. No. 15/019,577; with English translation.

* cited by examiner

TARGET SUPPLY APPARATUS AND EUV LIGHT GENERATING APPARATUS

CROSS-REFERENCE TO RELATED APPLICATIONS

This application claims priority to Application No. PCT/JP2013/075036 filed on Sep. 17, 2013. The entire contents of the above application are incorporated herein by reference in their entireties.

BACKGROUND

1. Technical Field

The present disclosure relates to a target supply device and an EUV light generation apparatus.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes from 70 nm to 45 nm and, further, microfabrication with feature sizes of 32 nm or less are expected to be required. In order to meet the demand for microfabrication with feature sizes of 32 nm or less, for example, an exposure apparatus is expected to be developed in which an apparatus for generating extreme ultraviolet (EUV) light at a wavelength of approximately 13 nm is combined with a reduced projection reflective optical system.

As an EUV light generation apparatus, three kinds of those have been proposed, which include a Laser Produced Plasma (LPP) type apparatus in which plasma is generated by irradiating a target material with a laser beam, a Discharge Produced Plasma (DPP) type apparatus in which plasma is generated by electric discharge, and a Synchrotron Radiation (SR) type apparatus in which orbital radiation is used to generate plasma.

SUMMARY

According to an aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes a gas flow path penetrating the second end portion of the tank and configured to guide the inert gas in a direction toward an inner wall of the main body.

According to another aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes a gas flow path penetrating the second end portion of the tank, and the gas flow path includes: a first flow path provided in the second end portion near an outside of the tank; and a plurality of second flow paths each having a smaller diameter than that of the first low path and provided in the second end portion near an inside of the tank.

According to still another aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes: a gas flow path penetrating the second end portion of the tank; a shielding member provided at a position distant from the second end portion of the tank and configured to shield an open face of the gas flow path from a liquid level of a target material contained in the tank; and a support configured to support the shielding member.

According to a further aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes: a gas flow path penetrating the second end portion of the tank; and a filter provided to the gas flow path to block at least a part of the gas flow path.

According to a still further aspect of the invention, an EUV light generation apparatus may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank; and a chamber configured to receive laser beam and the target material outputted from the nozzle, in which the inert gas supply unit includes: a gas flow path penetrating the second end portion of the tank and configured to guide the inert gas in a direction toward an inner wall of the main body, and the tank is fixed to the chamber with an axial direction of the main body being inclined relative to the gravity direction such that the inert gas, a travel direction of which is changed by colliding against the inner wall, obliquely collides against a liquid level of the target material.

BRIEF DESCRIPTION OF THE DRAWINGS

Hereinafter, selected exemplary embodiments of the present disclosure will be described with reference to the accompanying drawings.

DETAILED DESCRIPTION

Contents

1. Overview
2. Overall Description of EUV Light Generation Apparatus
2.1 Configuration
2.2 Operation
3. EUV Light Generation Apparatus Including Target Supply Device
3.1 Explanation of Terms
3.2 First Exemplary Embodiment
3.2.1 Configuration
3.2.2 Operation
3.3 Second Exemplary Embodiment
3.3.1 Configuration
3.3.2 Operation
3.4 Third Exemplary Embodiment
3.4.1 Configuration
3.4.2 Operation
3.5 Fourth Exemplary Embodiment
3.5.1 Configuration
3.5.2 Operation
3.6 Fifth Exemplary Embodiment
3.6.1 Configuration
3.6.2 Operation
3.7 Modification(s)

Figure 1:
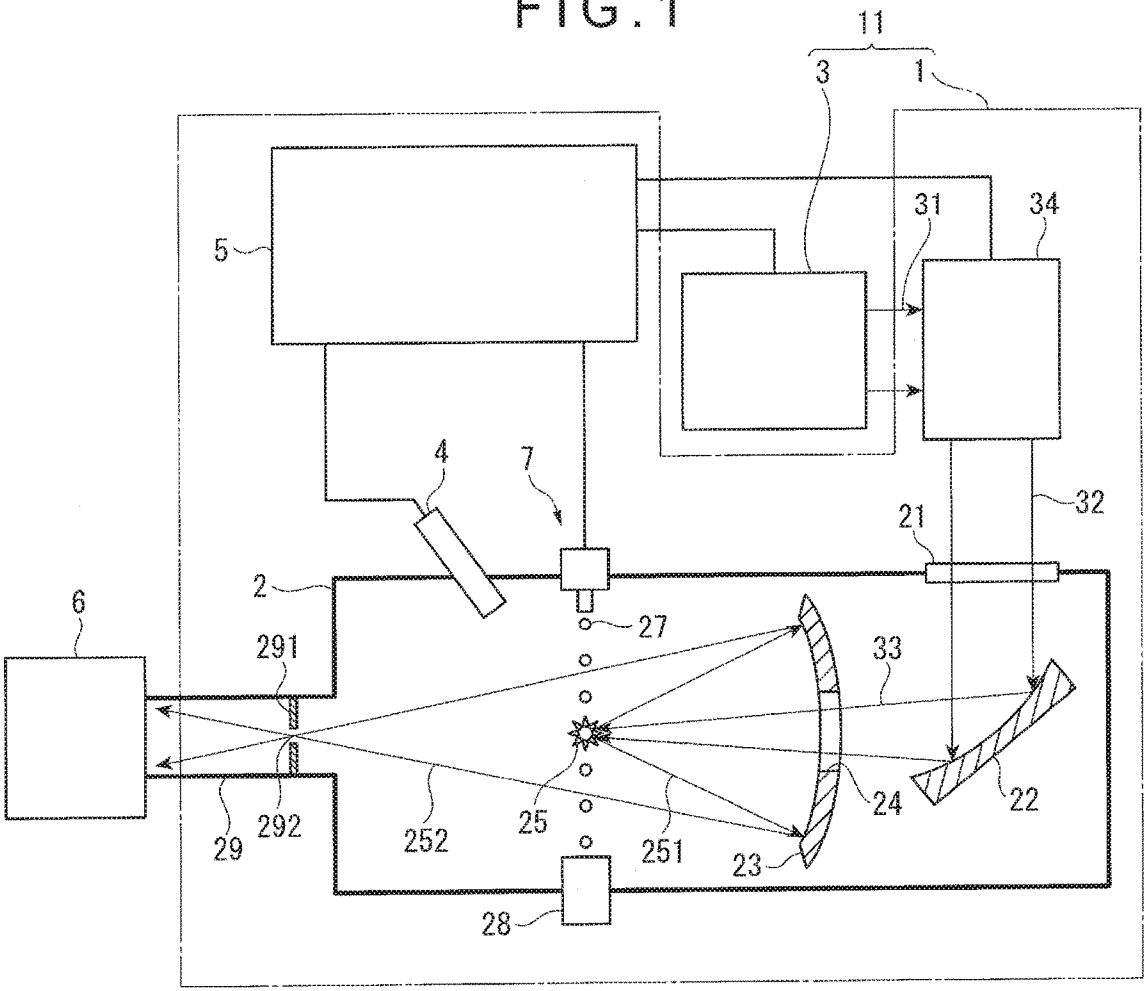
FIG. 1 schematically illustrates an exemplary configuration of an EUV light generation apparatus.

Hereinafter, selected exemplary embodiments of the present disclosure will be described in detail with reference to the accompanying drawings. The exemplary embodiments to be described below are merely illustrative in nature and do not limit the scope of the present disclosure. Further, the configuration(s) and operation(s) described in each embodiment are not always essential in implementing the present disclosure. In the exemplary embodiments to be described using the drawings except for FIG. 1, illustrations of component(s) not essential for describing the present disclosure in the components shown in FIG. 1 are occasionally omitted herein. Note that the like elements are referenced by the like reference numerals and characters, and duplicate descriptions thereof are omitted herein.

1. Overview

According to the above aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes a gas flow path penetrating the second end portion of the tank and configured to guide the inert gas in a direction toward an inner wall of the main body.

According to the another aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes a gas flow path penetrating the second end portion of the tank, and the gas flow path includes: a first flow path provided in the second end portion near an outside of the tank; and a plurality of second flow paths each having a smaller diameter than that of the first low path and provided in the second end portion near an inside of the tank.

According to the still another aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes: a gas flow path penetrating the second end portion of the tank; a shielding member provided at a position distant from the second end portion of the tank and configured to shield an open face of the gas flow path from a liquid level of a target material contained in the tank; and a support configured to support the shielding member.

According to the further aspect of the invention, a target supply device may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank, in which the inert gas supply unit includes: a gas flow path penetrating the second end portion of the tank; and a filter provided to the gas flow path to block at least a part of the gas flow path.

According to the still further aspect of the invention, an EUV light generation apparatus may include: a tank including a cylindrical main body, a first end portion blocking an axial first end of the main body, and a second end portion blocking an axial second end of the main body; a nozzle provided to the first end portion of the tank and configured to output a target material contained inside the tank; and an inert gas supply unit configured to supply inert gas into the tank; and a chamber configured to receive laser beam and the target material outputted from the nozzle, in which the inert gas supply unit includes: a gas flow path penetrating the second end portion of the tank and configured to guide the inert gas in a direction toward an inner wall of the main body, and the tank is fixed to the chamber with an axial direction of the main body being inclined relative to the gravity direction such that the inert gas, a travel direction of which is changed by colliding against the inner wall, obliquely collides against a liquid level of the target material.

2. Overall Description of EUV Light Generation Apparatus

2.1 Configuration

FIG. 1 schematically illustrates an exemplary configuration of an LPP-type EUV light generation system. An EUV light generation apparatus 1 may be used with at least one laser apparatus 3. Hereinafter, a system including the EUV light generation apparatus 1 and the laser apparatus 3 is referred to as an EUV light generation system 11. As shown in FIG. 1 and detailed below, the EUV light generation apparatus 1 may include a chamber 2 and a target supply device 7. The chamber 2 may be airtightly sealed. The target supply device 7 may be attached, for instance, to a wall of the chamber 2 to penetrate the wall. A target material to be supplied by the target supply device may include, but is not limited to, any one or more of tin, terbium, gadolinium, lithium and xenon.

The wall of the chamber 2 may have at least one through-hole. A window 21 may be provided in the through-hole and may transmit a pulse laser beam 32 outputted from the laser apparatus 3. An EUV collector mirror 23 having, for example, a spheroidal reflective surface may be provided in the chamber 2. The EUV collector mirror 23 may have a first focus and a second focus. The EUV collector mirror 23 may have a multi-layered reflective film on the surface thereof formed by alternately laminating molybdenum and silicon layers. For instance, preferably, the first focus of the EUV collector mirror 23 lies in a plasma generation region 25 and the second focus thereof lies at an intermediate focus (IF) 292. The EUV collector mirror 23 may have a through-hole 24 at the center thereof. The through-hole 24 may be configured to transmit a pulse laser beam 33.

The EUV light generation apparatus 1 may further include an EUV light generation control unit 5, a target sensor 4 and the like. The target sensor 4 may have an imaging function and be configured to detect a presence, locus, position, speed and the like of a droplet 27 as a target.

Moreover, the EUV light generation apparatus 1 may include a connection part 29 configured to bring an inside of the chamber 2 in communication with an inside of an exposure apparatus 6. A wall 291 having an aperture 293 may be provided in the connection part 29. The aperture 293 of the wall 291 may be positioned at the second focus of the EUV collector mirror 23.

Further, the EUV light generation apparatus 1 may also include a laser beam direction control unit 34, a laser beam focusing mirror 22, a target collection unit 28 configured to collect the droplet 27, and the like. The laser beam direction control unit 34 may include an optical element for defining a travel direction of the laser beam and an actuator configured to adjust a position, posture and the like of the optical element.

2.2 Operation

With reference to FIG. 1, a pulse laser beam 31 outputted from the laser apparatus 3 may pass through the laser beam direction control unit 34 and be outputted therefrom as the pulse laser beam 32 through the window 21 into the chamber 2. The pulse laser beam 32 may travel inside the chamber 2 along at least one laser beam path, be reflected by the laser beam focusing mirror 22, and strike at least one droplet 27 as the pulse laser beam 33.

The target supply device 7 may be configured to output the droplet 27 to the plasma generation region 25 inside the chamber 2. The droplet 27 may be irradiated with at least one pulse of the pulse laser beam 33. Upon being irradiated with the pulse laser beam, the droplet 27 can be turned into plasma, and a radiation light 251 can be emitted from the plasma. The EUV light 252 contained in the radiation light 251 may be selectively reflected by the EUV collector mirror 23. The EUV light 252 reflected by the EUV collector mirror may be focused at the intermediate focus 292 and be outputted to the exposure apparatus 6. Note that one droplet 27 may be irradiated with multiple pulses included in the pulse laser beam 33.

The EUV light generation control unit 5 may be configured to integrally control the EUV light generation system 11. The EUV light generation control unit 5 may be configured to process image data and the like of the droplet 27 taken by the target sensor 4. The EUV light generation control unit 5 may be configured to control, for instance, a timing for outputting the droplet 27 and a direction for outputting the droplet 27. Further, the EUV light generation control unit 5 may be configured to control a timing for laser oscillation of the laser apparatus 3, a travel direction of the pulse laser beam 32, a focusing position of the pulse laser beam 33, and the like. It will be appreciated that the various controls mentioned above are merely examples, and other controls may be added as necessary.

3. EUV Light Generation Apparatus Including Target Supply Device

3.1. Explanation of Terms

Hereinafter, in the description using the drawings except for FIG. 1, the terms regarding the direction may be described with reference to X, Y and Z axes shown in the drawings.

Note that a gravity direction 10B is irrelevant to the terms regarding the direction described above.

3.2 First Exemplary Embodiment

3.2.1 Configuration

Figure 2:
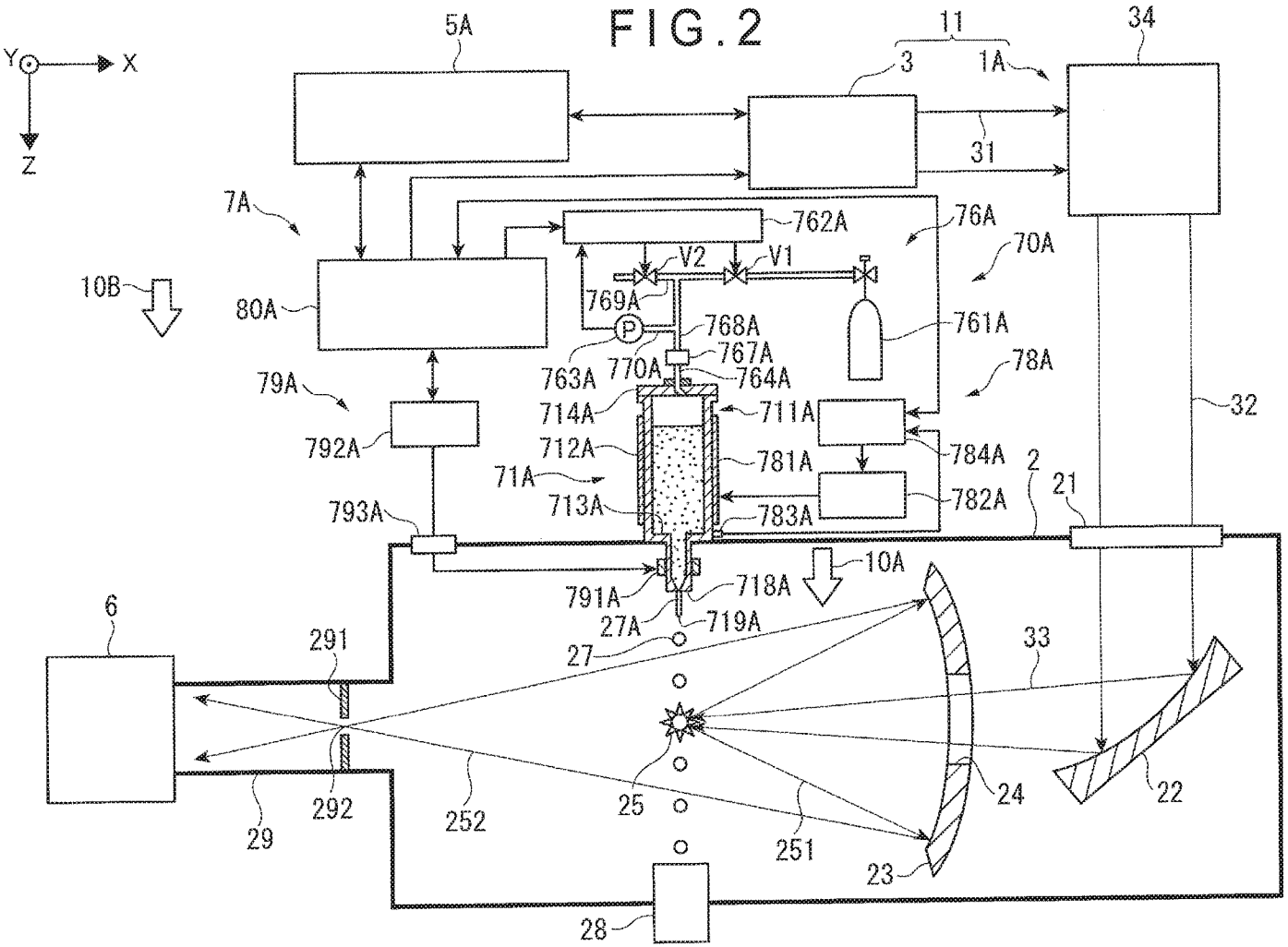
FIG. 2 schematically illustrates an exemplary configuration of the EUV light generation apparatus including a target supply device according to a first exemplary embodiment.
Figure 3:
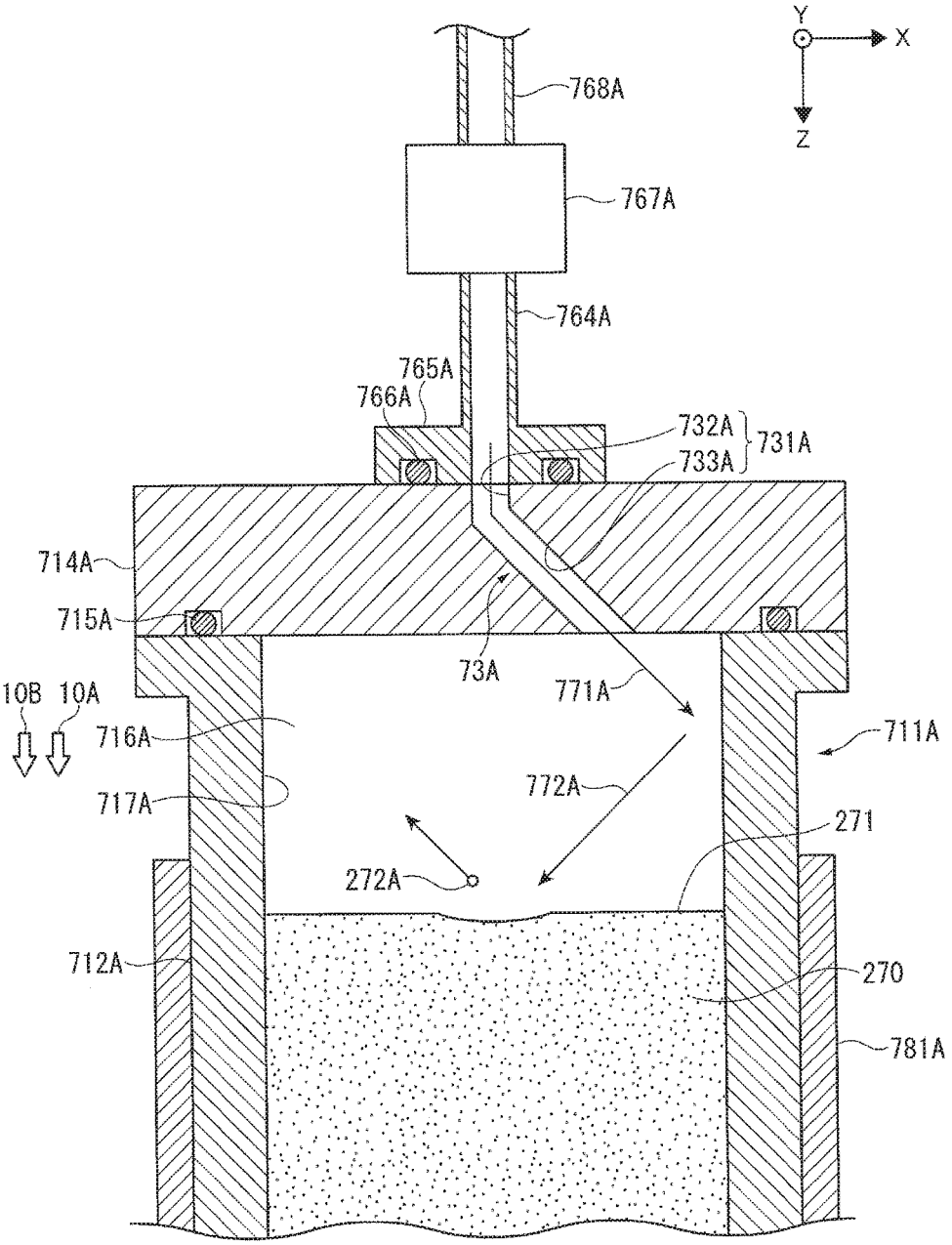
FIG. 3 schematically illustrates an exemplary configuration of the target supply device according to the first exemplary embodiment.

FIG. 2 schematically illustrates an exemplary configuration of the EUV light generation apparatus including the target supply devices according to the first exemplary embodiment and later-described second to fifth exemplary embodiments. FIG. 3 schematically illustrates an exemplary configuration of the target supply device according to the first exemplary embodiment.

An EUV light generation apparatus 1A may include the chamber 2 and a target supply device 7A as shown in FIG. 2. The target supply device 7A may include a target generator 70A and a target controller 80A. The target controller 80A may be electrically connected to the laser apparatus 3 and an EUV light generation control system 5A.

The target generator 70A may include a target generation unit 71A, an inert gas supply unit 73A, a pressure adjuster 76A, a temperature control unit 78A, and a piezo unit 79A, as shown in FIGS. 2 and 3.

The target generation unit 71A may be formed of a material (e.g., molybdenum) less reactive to a target material 270. The target generation unit 71A may include a tank 711A configured to contain the target material 270. The tank 711A may include a main body 712A, a bottom 713A as a first end portion and a cover 714A as a second end portion.

The main body 712A may be cylindrical.

The bottom 713A may block a +Z directional end (first end in an axial direction) of the main body 712A. The bottom 713A may be integrally formed with the main body 712A.

The cover 714A may block a −Z directional end (second end in the axial direction) of the main body 712A. The cover 714A may be formed as a separate body from the main body 712A. The cover 714A may be fixed to the main body 712A using a bolt (not shown). At this time, an O ring 715A may be fitted in a groove formed on a +Z directional surface of the cover 714A, thereby providing sealing between the main body 712A and the cover 714A.

A hollow portion of the tank 711A may be defined as a containing space 716A. The containing space 716A may be a space defined by an inner wall 717A of the main body 712A, a −Z directional surface of the bottom 713A, and the +Z directional surface of the cover 714A.

A nozzle 718A may be provided to the tank 711A. The nozzle 718A may be configured to output the target material 270 contained in the containing space 716A into the chamber as the droplet 27. The target generation unit 71A may include the tank 711A positioned outside the chamber 2 and the nozzle 718A positioned inside the chamber 2.

The nozzle 718A may have a nozzle hole 719A. The nozzle hole 719A may be opened substantially at the center of a +Z directional end of the nozzle 718A. The diameter of the nozzle hole 719A may be in a range from 3 μm to 15 μm. The nozzle 718A may be formed of a material having a low wettability against the target material 270. Specifically, the material having a low wettability against the target material 270 may be a material having a contact angle exceeding 90 degrees relative to the target material 270. The material having the contact angle exceeding 90 degrees may be any one of SiC, $SiO_2$, $Al_2O_3$, molybdenum, tungsten, and tantalum.

The preset output direction of the droplet 27 does not always coincide with the gravity direction 10B depending on a setting condition of the chamber 2. Hereinafter, the preset output direction of the droplet 27 is referred to as a preset output direction 10A, which may be a central axial direction of the nozzle hole 719A. The droplet 27 may be outputted in an oblique direction or a horizontal direction relative to the gravity direction 10B. In the first exemplary embodiment, the chamber 2 may be set with the preset output direction 10A coinciding with the gravity direction 10B.

The inert gas supply unit 73A may supply inert gas into the containing space 716A of the tank 711A. The inert gas supply unit 73A may include a gas flow path 731A. The gas flow path 731A may be provided in a form of a hole penetrating the cover 714A of the tank 711A.

The gas flow path 731A may include a first flow path 732A and a second flow path 733A.

The first flow path 732A may be provided in the cover 714A near an outside of the tank 711A. The first flow path 732A may extend in a direction substantially parallel to the gravity direction 10B. A diameter of the first flow path 732A may be in a range from 3 mm to 16 mm.

The second flow path 733A may have a diameter substantially equal to that of the first flow path 732A. The second flow path 733A may be provided in the cover 714A near an inside of the tank 711A. A −Z directional end of the second flow path 733A may be connected to a +Z directional end of the first flow path 732A. The second flow path 733A may extend in a direction inclined toward a +X direction relative to the gravity direction 10B. For instance, an angle formed between an axis of the second flow path 733A and an axis of the first flow path 732A may be in a range from 30 degrees to 60 degrees. With this configuration, the gas flow path 731A can guide the inert gas in a direction toward an inner wall 717A of the tank 711A.

A duct 764A may be provided to the cover 714A of the tank 711A. The duct 764A may have a flange 765A at an axial end. The flange 765A provided to the duct 764A may be fixed to a −Z directional surface of the cover 714A using a bolt (not shown). At this time, an O ring 766A may be fitted in a groove formed on a +Z directional surface of the flange 765A, thereby providing sealing between the flange 765A and the cover 714A. The duct 764A may be provided with an axial direction thereof substantially in parallel with the gravity direction 10B. The duct 764A may be provided with an inner space thereof in communication with the gas flow path 731A.

A first end of a duct 768A may be connected to a −Z directional end of the duct 764A through a joint 767A. A second end of the duct 768A may be connected to an inert gas cylinder 761A through a pressure adjuster 76A. With this configuration, inert gas contained in the inert gas cylinder 761A can be supplied to the target generation unit 71A.

A pressure adjuster 76A may be provided to the duct 768A. The pressure adjuster 76A may include a first valve V1, a second valve V2, a pressure control unit 762A, and a pressure sensor 763A.

The first valve V1 may be provided to the duct 768A.

A duct 769A may be connected to the duct 768A between the first valve V1 and the tank 711A. Specifically, a first end of the duct 769A may be connected to a side of the duct 768A. A second end of the duct 769A may be opened.

The second valve V2 may be provided in the middle of the duct 769A.

The first valve V1 and the second valve V2 may be provided by a gate valve, a ball valve, a butterfly valve or the like. The first valve V1 and the second valve V2 may be of the same kind or different kinds.

The first valve V1 and the second valve V2 may be electrically connected to the pressure control unit 762A. The target controller 80A may transmit a signal with regard to the first valve V1 and the second valve V2 to the pressure control unit 762A. The first valve V1 and the second valve V2 may be each independently switched in response to the signal transmitted from the pressure control unit 762A.

The ducts 764A, 768A, 769A and 770A and the joint 767A may be formed of, for instance, stainless steel.

When the first valve V1 is opened, the inert gas contained in the inert gas cylinder 761A can be supplied into the target generation unit 71A through the ducts 768A and 764A and the gas flow path 731A. When the second valve V2 is closed, the inert gas present in the ducts 768A and 764A, the gas flow path 731A and target generation unit 71A can be prevented from being discharged from the second end of the duct 769A to the outside of duct 769A. With this configuration, when the first valve V1 is opened and the second valve V2 is closed, an internal pressure of the target generation unit 71A can be increased to an internal pressure of the inert gas cylinder 761A. Subsequently, the internal pressure of the target generation unit 71A is maintainable at the internal pressure of the inert gas cylinder 761A.

When the first valve V1 is closed, the inert gas contained in the inert gas cylinder 761A can be prevented from being supplied into the target generation unit 71A through the ducts 768A and 764A and the gas flow path 731A. When the second valve V2 is opened, the inert gas present in the ducts 768A and 764A, the gas flow path 731A and the target generation unit 71A can be discharged from the second end of the duct 769A to the outside of the duct 769A because of a difference between an internal pressure of the ducts 768A and 764A, the gas flow path 731A and target generation unit 71A and an external pressure of the ducts 768A and 764A, the gas flow path 731A and target generation unit 71A. With this configuration, when the first valve V1 is closed and the second valve V2 is opened, the internal pressure of the target generation unit 71A can be decreased.

A duct 770A may be connected to the duct 768A between the duct 769A and the tank 711A. A first end of the duct 770A may be connected to a side of the duct 768A. The pressure sensor 763A may be provided to a second end of the duct 770A. The pressure control unit 762A may be electrically connected to the pressure sensor 763A. The pressure sensor 763A may detect a pressure of inert gas present in the duct 770A and transmit a signal corresponding to the detected pressure to the pressure control unit 762A. The internal pressure of the duct 770A can be the same as the pressures of the respective duct 768A, duct 764A, gas flow path 731A and target generation unit 71A.

The temperature control unit 78A may be configured to control a temperature of the target material 270 in the tank 711A. The temperature control unit 78A may include a heater 781A, a heater power source 782A, a temperature sensor 783A, and a temperature controller 784A. The heater 781A may be provided to an outer circumferential surface of the tank 711A. In response to a signal from the temperature controller 784A, the heater power source 782A may supply electric power to the heater 781A to heat the heater 781A. With this operation, the target material 270 inside the tank 711A can be heated via the tank 711A.

The temperature sensor 783A may be provided on the outer circumferential surface of the tank 711A near the nozzle 718A, or may be provided inside the tank 711A. The temperature sensor 783A may be configured to detect a temperature at or near a setting position of the temperature sensor 783A of the tank 711A and transmit a signal corresponding to the detected temperature to the temperature controller 784A. The temperature at or near the setting position of the temperature sensor 783A can be substantially the same as the temperature of the target material 270 inside the tank 711A.

The temperature controller 784A may be configured to output to the heater power source 782A a signal for controlling the temperature of the target material 270 to a predetermined temperature, in response to the signal from the temperature sensor 783A.

The piezo unit 79A may include a piezo element 791A and a power source 792A. The piezo element 791A may be provided to an outer circumferential surface of the nozzle 718A in the chamber 2. The piezo element 791A may be replaced by a mechanism capable of oscillating the nozzle 718A at a high speed. The power source 792A may be electrically connected to the piezo element 791A via a feed-through 793A. The power source 792A may be electrically connected to the target controller 80A.

The target generator 70A may be configured to generate a jet 27A by continuous jetting and oscillate the jet 27A outputted from the nozzle 718A, thereby generating the droplet 27.

3.2.2 Operation

Figure 4:
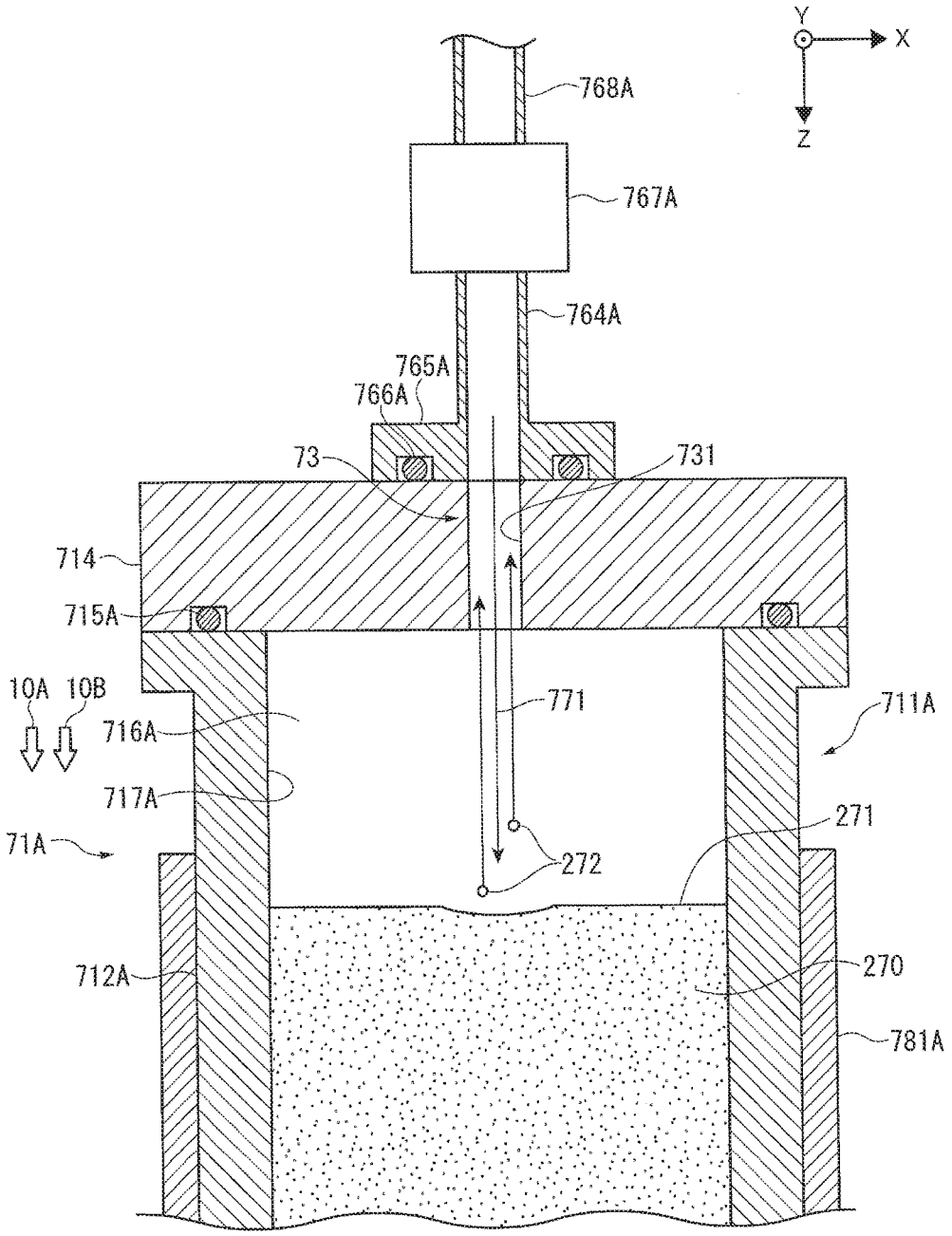
FIG. 4 schematically illustrates a target material scattered in an opposite direction from the gravity direction due to inert gas supplied to a target generation unit.

FIG. 4 schematically illustrates the problem that target material is scattered in an opposite direction from the gravity direction due to the inert gas supplied to the target generation unit.

The operation of the target supply device 7A will be described below with reference to an example where the target material 270 is tin.

The target supply device may have the same configuration as that of the target supply device 7A in the first exemplary embodiment, except that the inert gas supply unit 73 is used in place of the inert gas supply unit 73A as shown in FIG. 4.

The inert gas supply unit 73 may include a gas flow path 731. The gas flow path 731 may be provided in a form of a hole penetrating the cover 714. The gas flow path 731 may extend in a direction substantially parallel to the gravity direction 10B. The gas flow path 731 may have a diameter substantially equal to that of the first flow path 732A.

With respect to such a target supply device, the target controller 80A may transmit a signal to the temperature control unit 78A to heat the target material 270 in the target generation unit 71A to a predetermined temperature at or exceeding a melting point of the target material 270.

The target controller 80A may transmit a signal having a predetermined frequency to the piezo element 791A. With this operation, the piezo element 791A can be oscillated to periodically generate the droplet 27 from the jet 27A.

The target controller 80A may transmit a signal to the pressure control unit 762A to set the internal pressure of the target generation unit 71A at a target pressure Pt. The pressure control unit 762A may control to open and close the first valve V1 and the second valve V2 in order to decrease a value of a difference ΔP between a pressure P measured by the pressure sensor 763A and the target pressure Pt. With this operation, the inert gas contained in the inert gas cylinder 761A can be supplied into the target generation unit 71A to stabilize the internal pressure of the target generation unit 71A at the target pressure Pt. When the internal pressure of the target generation unit 71A reaches the target pressure Pt, the nozzle 718A can output the jet 27A and generate the droplet 27 according to oscillation of the nozzle 718A.

After the supply of the inert gas to the target generation unit 71A is started, the internal pressure of the target generation unit 71A may be sharply increased from 0.1 Mpa to 20 Mpa.

At this time, the gas flow path 731 may guide the inert gas 771 in a direction substantially equal to the gravity direction 10B. The inert gas 771 guided in the direction substantially equal to the gravity direction 10B may substantially vertically collide against a liquid level 271 of the target material 270. Due to this collision, the target material 272 may be scattered in a direction substantially opposite from a travel direction of the inert gas 771 and reach a +Z directional opening of the gas flow path 731. Since the gas flow path 731 extends in the direction substantially parallel to the gravity direction 10B, in other words, in the direction substantially parallel to a direction where the target material 272 is scattered, the target material 272 may enter the gas flow path 731. The target material 272 entering the gas flow path 731 may adhere to an inside of at least one of the ducts 764A, 768A, 769A and 770A and the joint 767A. Since the ducts 764A, 768A, 769A and 770A and the joint 767A are not heated, the target material 272 adhering on the inside of at least one of those may be cooled to be solidified. The solidified target material 272 may hinder the supply of the inert gas 771.

Moreover, the adhering target material 272 may react with at least one of the ducts 764A, 768A, 769A and 770A and the joint 767A to generate impurities. Since the gas flow path 731 extends in the direction substantially parallel to the gravity direction 10B, when the target material 272 containing the impurities falls, the target material 272 containing the impurities may pass through the gas flow path 731 to reach an inside of the target generation unit 71A. As a result, the impurities may block the nozzle hole 719A of the nozzle 718A.

In order to prevent such phenomenon, the target generation unit 71A of the target supply device 7A may be configured as shown in FIG. 3.

In the target supply device 7A shown in FIG. 3, when the supply of the inert gas into the target generation unit 71A is started, the gas flow path 731A may guide an inert gas 771A through the second flow path 733A in a direction inclined in the +X direction relative to the gravity direction 10B. The inert gas 771A guided by the gas flow path 731A may collide against the inner wall 717A of the tank 711A before colliding against the liquid level 271 of the target material 270. The inert gas 771A after colliding against the inner wall 717A, a travel direction of which is changed and a flow rate of which is reduced, may collide against the liquid level 271 as an inert gas 772A. At this time, since the flow rate of the inert gas 772A is lower than that of the inert gas 771A, scattering of the target material 272A can be restrained as compared with the configuration as shown in FIG. 4. Consequently, the target material 272A can be restrained from reaching the cover 714A and entering the gas flow path 731A.

Moreover, although the target material 272A may reach the cover 714A, the inert gas 772A may obliquely collide against the liquid level 271. Due to this collision, the target material 272A may be scattered in an oblique direction relative to the liquid level 271, in other words, in a direction inclined in the −X direction relative to the −Z direction. Consequently, the target material 272A can be restrained from reaching a +Z directional opening of the gas flow path 731A and entering the gas flow path 731A.

Since the target material 272A can be restrained from entering the gas flow path 731A as described above, the target material 272A can be restrained from being solidified in the inside of the ducts 764A, 768A, 769A and 770A and the joint 767A. Consequently, it can be restrained to hinder the supply of the inert gas 771A.

The target material 272A may enter the gas flow path 731A and adhere to at least one of the ducts 764A, 768A, 769A and 770A and the joint 767A. Moreover, the target material 272A may react with at least one of the ducts 764A, 768A, 769A and 770A and the joint 767A to generate impurities. Since the second flow path 733A of the gas flow path 731A extends in the direction inclined in the +X direction relative to the gravity direction 10B, even when the target material 272A containing the impurities falls, the target material 272A may adhere to the second flow path 733A and be restrained from reaching the inside of the target generation unit 71A. As a result, it can be restrained that the impurities block the nozzle hole 719A of the nozzle 718A.

3.3 Second Exemplary Embodiment

3.3.1 Configuration

Figure 5:
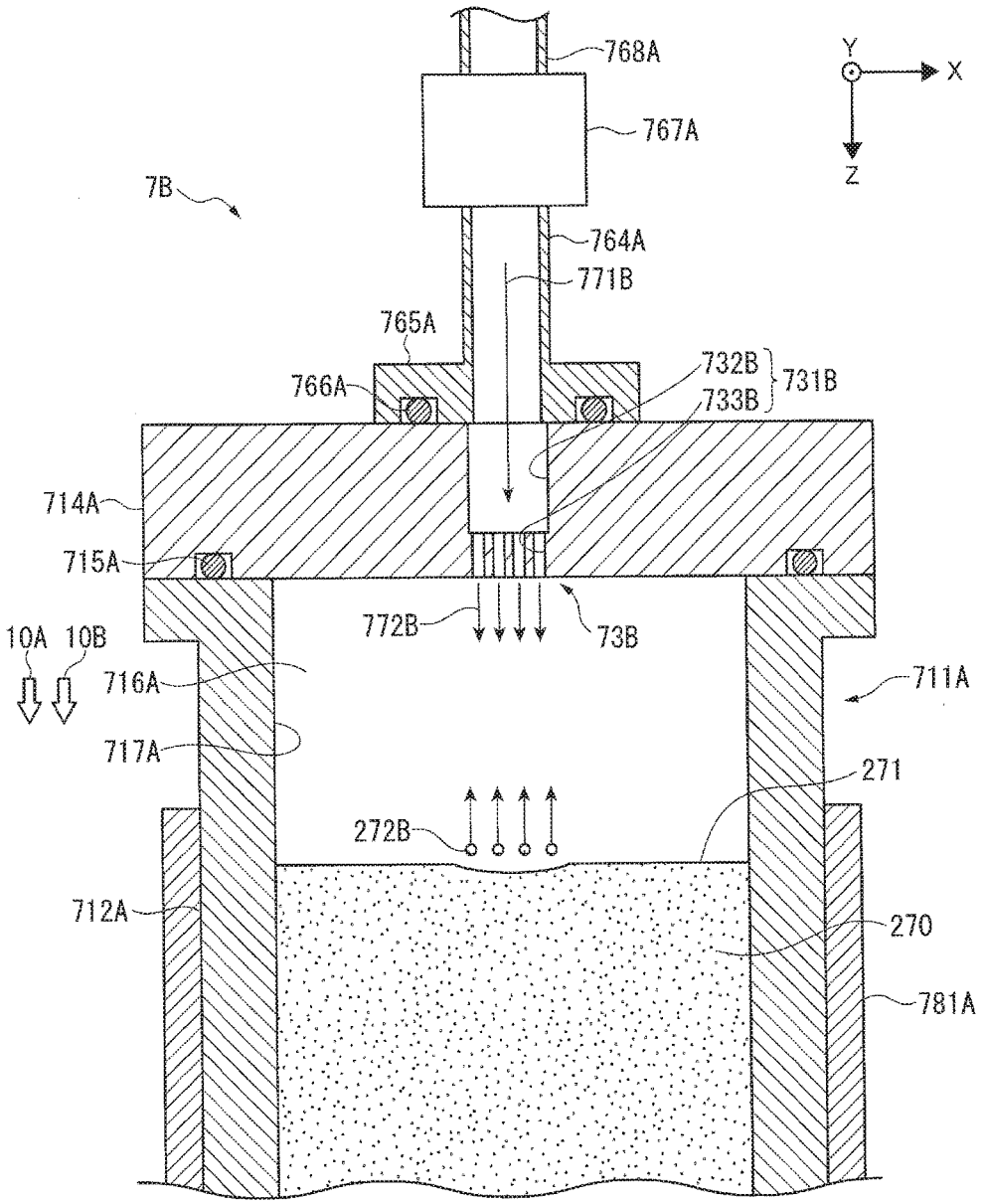
FIG. 5 schematically illustrates an exemplary configuration of a target supply device according to a second exemplary embodiment.

FIG. 5 schematically illustrates an exemplary configuration of a target supply device according to a second exemplary embodiment.

A target supply device 7B according to the second exemplary embodiment may have the same configuration as that of the target supply device 7A in the first exemplary embodiment, except for an inert gas supply unit 73B.

The inert gas supply unit 73B may include a gas flow path 731B. The gas flow path 731B may be provided in a form of holes penetrating the cover 714A of the tank 711A.

The gas flow path 731B may include one first flow path 732B and a plurality of second flow paths 733B.

The first flow path 732B may be provided on an outer side of the tank 711A. The first flow path 732B may extend in a direction substantially parallel to the gravity direction 10B. The first flow path 732B may have a diameter substantially equal to that of the gas flow path 731. For instance, a diameter of the first flow path 732B may be in a range from 3 mm to 16 mm.

Each of the second flow paths 733B may have a smaller diameter than that of the first flow path 732B. For instance, the diameter of each of the second flow paths 733B may be in a range from 0.3 mm to 2 mm. The diameter of each of the second flow paths 733B is preferably smaller than a maximum diameter of the target material 272B to be scattered due to the duct 764A and the inert gas 772B. The second flow paths 733B may be provided in the cover 714A near the inside of the tank 711A. A −Z directional end of each of the second flow paths 733B may be connected to a +Z directional end of the first flow path 732B. A −Z directional open face defined by the plurality of second flow paths 733B may be positioned in plane with a +Z directional open face of the first flow path 732B. The second flow paths 733B may extend in the direction substantially parallel to the gravity direction 10B, in other words, in a direction substantially parallel to the first flow path 732B. With this configuration, the gas flow path 731B can reduce the flow rate of the inert gas by guiding the inert gas guided by the first flow path 732B to the plurality of second flow paths 733B.

3.3.2 Operation

An operation of the target supply device 7B will be described below.

Hereinafter, the description of the same operations as in the first exemplary embodiment is omitted.

In the target supply device 7B shown in FIG. 5, the temperature control unit 78A may melt the target material 270 and the piezo element 791A may oscillate the nozzle 718A. When the pressure control unit 762A starts supplying the inert gas into the target generation unit 71A, the gas flow path 731B may guide an inert gas 771B through the first flow path 732B in the direction substantially equal to the gravity direction 10B. After passing through the first flow path 732B, the inert gas 771B may be guided into the plurality of second flow paths 733B, where a flow rate of the inert gas 771B is reduced, and may collide against the liquid level 271 as the inert gas 772B. At this time, since the flow rate of the inert gas 772B is lower than that of the inert gas 771B, scattering of the target material 272B can be restrained as compared with the configuration as shown in FIG. 4. Consequently, the target material 272B can be restrained from reaching the cover 714A and entering the gas flow path 731B.

Since the inert gas 772B may substantially vertically collide against the liquid level 271, the target material 272B may be scattered in a direction substantially opposite from a travel direction of the inert gas 772B and reach a +Z directional opening of the gas flow path 731B. However, since each of the openings of the second flow paths 733B is smaller than the opening of the first flow path 732B, the target material 272B can be restrained from entering the gas flow path 731B.

Since the target material 272B can be restrained from entering the gas flow path 731B as described above, the target material 272B may be restrained from being solidified in the inside of the ducts 764A, 768A, 769A and 770A and the joint 767A. Consequently, it can be restrained to hinder the supply of the inert gas 771B.

The target material 272B may enter the gas flow path 731B and adhere to at least one of the ducts 764A, 768A, 769A and 770A and the joint 767A. Moreover, the target material 272B may react with at least one of the ducts 764A, 768A, 769A and 770A and the joint 767A to generate impurities. Since the diameter of each of the second flow paths 733B of the gas flow path 731B is smaller than the maximum width of the impurities, it can be restrained that the target material 272B containing the impurities passes through the second flow paths 733B to reach the inside of the target generation unit 71A. As a result, it can be restrained that the impurities block the nozzle hole 719A of the nozzle 718A.

3.4 Third Exemplary Embodiment

3.4.1 Configuration

Figure 6:
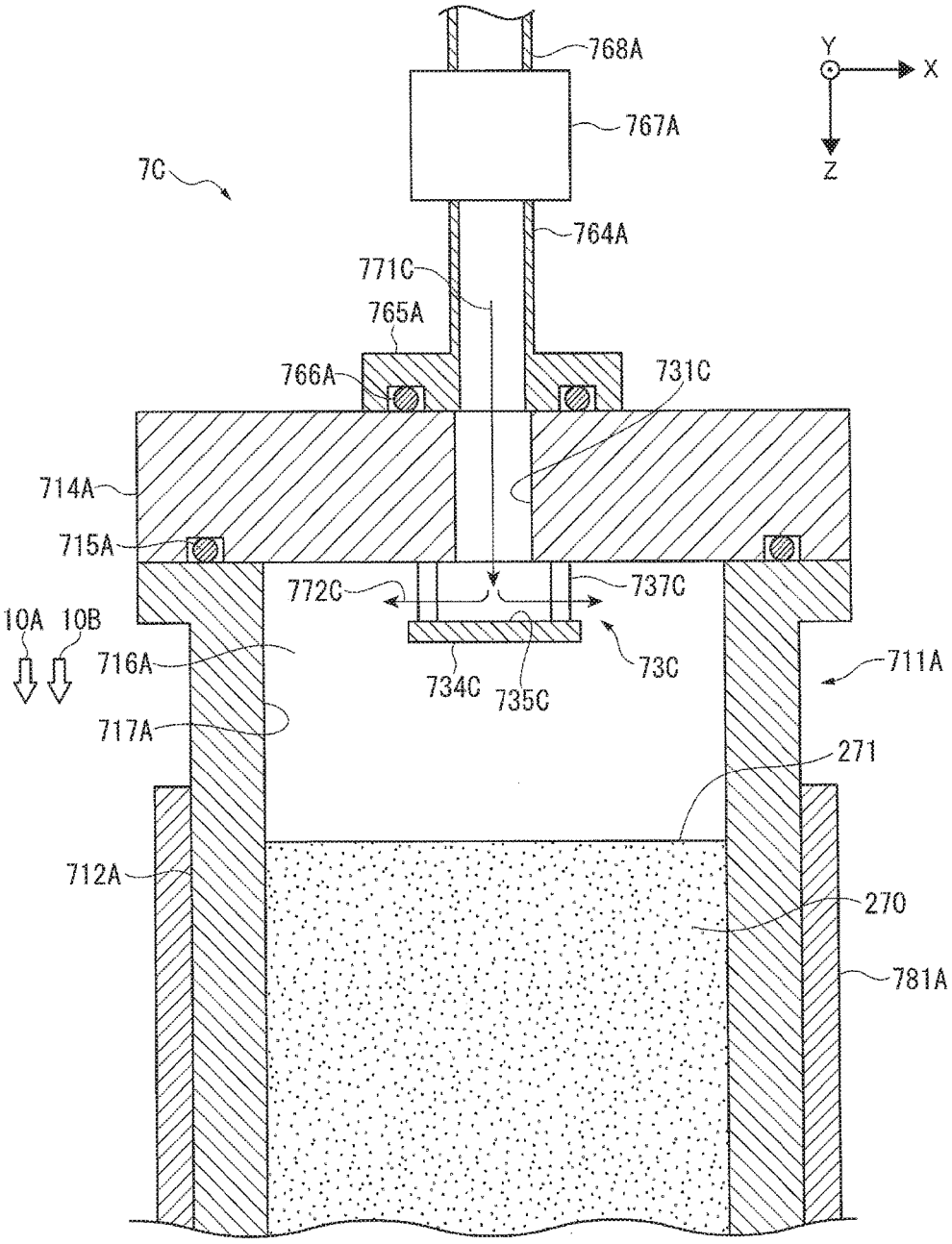
FIG. 6 schematically illustrates an exemplary configuration of a target supply device according to a third exemplary embodiment.

FIG. 6 schematically illustrates an exemplary configuration of a target supply device according to a third exemplary embodiment.

A target supply device 7C according to the third exemplary embodiment may have the same configuration as that of the target supply device 7A in the first exemplary embodiment, except for an inert gas supply unit 73C.

The inert gas supply unit 73C may include a gas flow path 731C, a shielding member 734C, and a plurality of poles 737C as a support.

The gas flow path 731C may be provided in a form of a hole penetrating the cover 714A of the tank 711A. The gas flow path 731C may extend in the direction substantially parallel to the gravity direction 10B. The gas flow path 731C may have a diameter substantially equal to that of the gas flow path 731. For instance, a diameter of the gas flow path 731C may be in a range from 3 mm to 16 mm.

The shielding member 734C may be formed in a substantially disc-shape. A diameter of the shielding member 734C may be larger than that of the gas flow path 731C.

The poles 737C may be fixed to a +Z directional surface of the cover 714A and may extend in the +Z direction from the +Z directional surface of the cover 714A. The poles 737C may be disposed substantially at equal intervals along a periphery of the gas flow path 731C. The shielding member 734C may be fixed to leading ends of the poles 737C. The shielding member 734C may be fixed to the poles 737C with a first surface 735C of the shielding member 734C substantially in parallel with the +Z directional surface of the cover 714A. With this configuration, the shielding member 734C can shield an open face of the gas flow path 731C from the liquid level 271 at a position distant from the cover 714A inside the tank 711A. The shielding member 734C can guide an inert gas 771C passing through the gas flow path 731C toward the inner wall 717A of the main body 712A along the first surface 735C.

The shielding member 734C and the poles 737C may be formed of a material less reactive to tin (i.e., the target material 270). The material is exemplified by a material having a high melting point such as molybdenum and tungsten. For instance, the shielding member 734C and the poles 737C may be formed of ceramics such as aluminum oxide, silicon oxide and silicon carbide.

3.4.2 Operation

An operation of the target supply device 7C will be described below.

Hereinafter, the description of the same operations as in the first exemplary embodiment is omitted.

In the target supply device 7C shown in FIG. 6, the temperature control unit 78A may melt the target material 270 and the piezo element 791A may oscillate the nozzle 718A. When the pressure control unit 762A starts supplying the inert gas into the target generation unit 71A, the gas flow path 731C may guide the inert gas 771C in the direction substantially equal to the gravity direction 10B. After passing through the gas flow path 731C, the inert gas 771C may collide against the first surface 735C of the shielding member 734C, where a flow rate of the inert gas 771C is reduced, and may be radially dispersed as an inert gas 772C. After colliding against the inner wall 717A, the inert gas 772C may collide against the liquid level 271. At this time, since the flow rate of the inert gas 772C is lower than that of the inert gas 771C, scattering of the target material can be restrained as compared with the configuration as shown in FIG. 4. Consequently, the target material can be restrained from reaching the cover 714A and entering the gas flow path 731C.

Since the inert gas 772B collides against the liquid level 271, the target material may be scattered in the −Z direction. However, since the shielding member 734C shields the open face of the gas flow path 731C, the target material can be restrained from entering the gas flow path 731C.

Since the target material can be restrained from entering the gas flow path 731C as described above, the target material can be restrained from being solidified in the inside of the ducts 764A, 768A, 769A and 770A and the joint 767A. Consequently, it can be restrained to hinder the supply of the inert gas 771C.

The target material may enter the gas flow path 731C and adhere to at least one of the ducts 764A, 768A, 769A and 770A and the joint 767A. Moreover, the target material may react with at least one of the ducts 764A, 768A, 769A and 770A and the joint 767A to generate impurities. Since the shielding member 734C having a larger diameter than that of the gas flow path 731C is provided to the gas flow path 731C in the +Z direction, even when the target material falls, the target material may adhere to the first surface 735C of the shielding member 734C and be restrained from reaching the inside of the target generation unit 71A. As a result, it can be restrained that the impurities block the nozzle hole 719A of the nozzle 718A.

3.5 Fourth Exemplary Embodiment

3.5.1 Configuration

Figure 7:
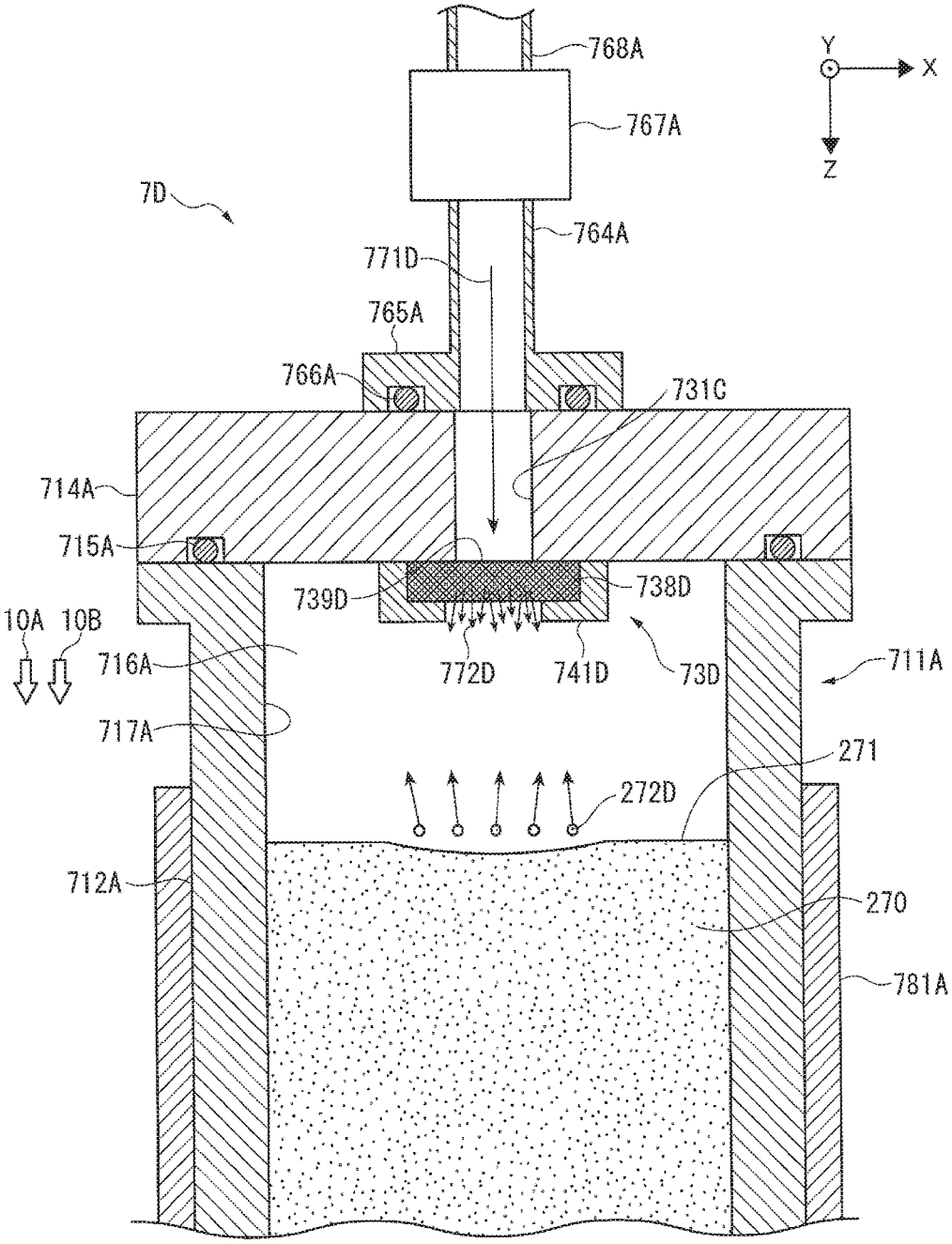
FIG. 7 schematically illustrates an exemplary configuration of a target supply device according to a fourth exemplary embodiment.

FIG. 7 schematically illustrates an exemplary configuration of a target supply device according to a fourth exemplary embodiment.

A target supply device 7D according to the fourth exemplary embodiment may have the same configuration as that of the target supply device 7A in the first exemplary embodiment, except for an inert gas supply unit 73D.

The inert gas supply unit 73D may include a gas flow path 731C, a filter 738D, and a holder 741D.

The filter 738D may be a porous filter. The filter 738D may have numerous penetration pores each having a diameter of approximately 3 μm to 20 μm. The filter 738D may be formed in a substantially disc-shape. A diameter of the filter 738D may be larger than that of the gas flow path 731C. The filter 738D may be formed of a material less reactive to tin (i.e., the target material 270). Examples of the material include molybdenum, tungsten, aluminum oxide-silicon dioxide glass, and silicon carbide.

The holder 741D may be fixed to the +Z directional surface of the cover 714A. The holder 741D may hold the filter 738D from the +Z direction. The holder 741D may hold the filter 738D such that the open face of the gas flow path 731C is positioned in plane with a first surface 739D of the filter 738D and the first surface 739D is in tight contact with the +Z directional surface of the cover 714A. With this configuration, the filter 738D can block an end of the gas flow path 731C near the inside of the tank 711A.

The holder 741D may be formed of the material less reactive to tin (i.e., the target material 270). The material is exemplified by a material having a high melting point such as molybdenum and tungsten. For instance, the holder 741D may be formed of ceramics such as aluminum oxide, silicon oxide and silicon carbide.

3.5.2 Operation

An operation of the target supply device 7D will be described below.

Hereinafter, the description of the same operations as in the first exemplary embodiment is omitted.

In the target supply device 7D shown in FIG. 7, the temperature control unit 78A may melt the target material 270 and the piezo element 791A may oscillate the nozzle 718A. When the pressure control unit 762A starts supplying the inert gas into the target generation unit 71A, the gas flow path 731C may guide the inert gas 771D in the direction substantially equal to the gravity direction 10B. After passing through the gas flow path 731C, the inert gas 771D may enter the filter 738D, where a flow rate of the inert gas 771D is reduced, and may pass through the numerous penetration pores as an inert gas 772D. The inert gas 772D may travel in the direction substantially equal to the gravity direction 10B and collide against the liquid level 271. At this time, since the flow rate of the inert gas 772D is lower than that of the inert gas 771D, scattering of the target material 272D can be restrained as compared with the configuration as shown in FIG. 4. Consequently, the target material 272D can be restrained from reaching the cover 714A and entering the gas flow path 731C.

Since the inert gas 772D collides against the liquid level 271, the target material 272D may be scattered in the −Z direction. However, since the filter 738D blocks the open face of the gas flow path 731C, the target material 272D can be restrained from entering the gas flow path 731C.

Since the target material 272D can be restrained from entering the gas flow path 731C as described above, the target material 272D can be restrained from being solidified in the inside of the ducts 764A, 768A, 769A and 770A and the joint 767A. Consequently, it can be restrained to hinder the supply of the inert gas 771D.

The fine target material 272D may enter the gas flow path 731C and adhere to at least one of the ducts 764A, 768A, 769A and 770A and the joint 767A. Moreover, the target material may react with at least one of the ducts 764A, 768A, 769A and 770A and the joint 767A to generate impurities. Since the +Z directional end of the gas flow path 731C is blocked by the filter 738D, even when the target material 272D containing the impurities falls, the target material 272D may adhere to the filter 738D and be restrained from reaching the inside of the target generation unit 71A. Consequently, it can be restrained that the impurities block the nozzle hole 719A of the nozzle 718A.

3.6 Fifth Exemplary Embodiment

3.6.1 Configuration

Figure 8:
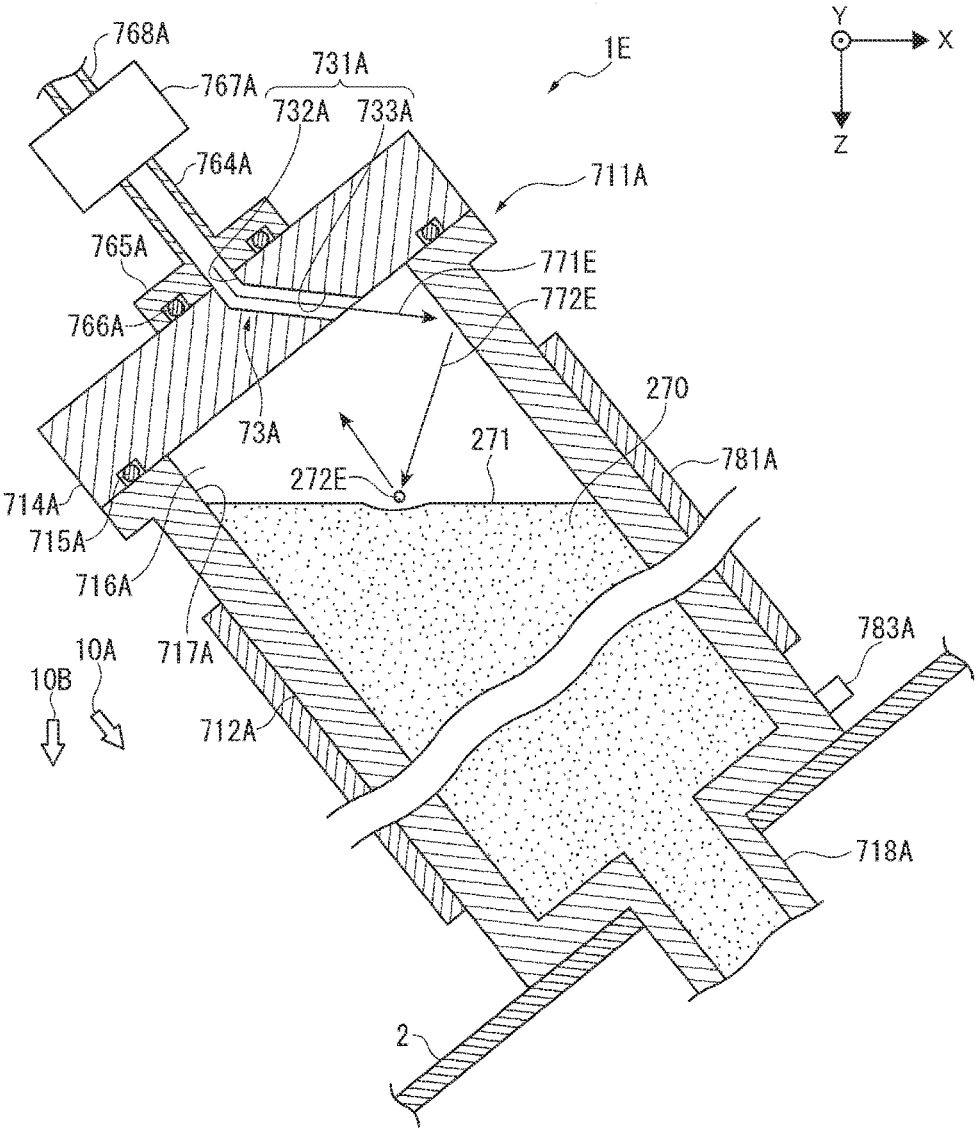
FIG. 8 schematically illustrates an exemplary configuration of an EUV light generation apparatus according to a fifth exemplary embodiment.

FIG. 8 schematically illustrates an exemplary configuration of an EUV light generation apparatus according to a fifth exemplary embodiment.

An EUV light generation apparatus 1E according to the fifth exemplary embodiment may have the same configuration as that of the EUV light generation apparatus 1A according to the first exemplary embodiment, except that the chamber 2 and the target generation unit 71A are set at different angles.

The chamber 2 may be set with the preset output direction 10A inclined relative to the gravity direction 10B.

The tank 711A of the target generation unit 71A may be fixed to the chamber 2 with the main body 712A having an axial direction inclined relative to the gravity direction 10B. The tank 711A may be fixed to the chamber 2 such that the inert gas, a travel direction of which is changed by colliding against the inner wall 717A, obliquely collides against the liquid level 271 of the target material 270.

3.6.2 Operation

An operation of the EUV light generation apparatus 1E will be described below.

Hereinafter, the description of the same operations as in the first exemplary embodiment is omitted.

In the EUV light generation apparatus 1E shown in FIG. 8, the temperature control unit 78A may melt the target material 270 and the piezo element 791A may oscillate the nozzle 718A. When the pressure control unit 762A starts supplying the inert gas into the target generation unit 71A, the gas flow path 731A may guide the inert gas 771E in a direction substantially orthogonal to the gravity direction 10B. The inert gas 771E guided by the gas flow path 731A may collide against the inner wall 717A of the tank 711A before colliding against the liquid level 271 of the target material 270. The inert gas 771E after colliding against the inner wall 717A, a travel direction of which is changed and a flow rate of which is reduced, may collide against the liquid level 271 as an inert gas 772E. At this time, since the flow rate of the inert gas 772E is lower than that of the inert gas 771E, scattering of a target material 272E can be restrained as compared with the configuration as shown in FIG. 4. Consequently, the target material 272E can be restrained from reaching the cover 714A and entering the gas flow path 731A.

The target material 272E may reach the cover 714A. The inert gas 772E may obliquely collide against the liquid level 271. With this collision, the target material 272E may be scattered in a direction oblique to the liquid level 271. Consequently, the target material 272E can be restrained from reaching the +Z directional opening of the gas flow path 731A and entering the gas flow path 731A.

Since the target material 272E can be restrained from entering the gas flow path 731A as described above, the target material 272E can be restrained from being solidified in the inside of the ducts 764A, 768A, 769A and 770A and the joint 767A. Consequently, it can be restrained to hinder the supply of the inert gas 771E.

The target material 272E may enter the gas flow path 731A and adhere to at least one of the ducts 764A, 768A, 769A and 770A and the joint 767A. The target material 272E may react with at least one of the ducts 764A, 768A, 769A and 770A and the joint 767A to generate impurities. Since the second flow path 733A of the gas flow path 731A extends in the direction inclined relative to the gravity direction 10B, even when the target material 272E containing the impurities falls, the target material 272E may adhere to the second flow path 733A and be restrained from reaching the inside of the target generation unit 71A. Consequently, it can be restrained that the impurities block the nozzle hole 719A of the nozzle 718A.

3.7 Modification(s)

The target supply device may have a configuration described below.

In the first and fifth exemplary embodiments, the first flow path 732A of the gas flow path 731A may extend in the same direction as that of the second flow path 733A.

In the second exemplary embodiment, the second flow paths 733B of the gas flow path 731B may extend in a direction inclined relative to the gravity direction 10B.

In the third exemplary embodiment, the shape of the first surface 735C of the shielding member 734C may be substantially the same as that of the open face of the gas flow path 731C.

In the fourth exemplary embodiment, two or more filters 738D may be provided. The diameter of each of the penetration pores of the two or more filters 738D may be mutually different or substantially the same. The filter 738D may be fixed to an inside of the gas flow path 731C. When the filter 738D is fixed to the inside of the gas flow path 731C, the filter 738D may be provided over all or a part of the gas flow path 731C.

In the second, third and fourth exemplary embodiments, the tank 711A of the target supply devices 7B, 7C and 7D may be fixed to the chamber 2 with the axial direction of the main body 712A being inclined relative to the gravity direction 10B.

In the first to fifth exemplary embodiments, the gas flow paths 731A, 731B and 731C are provided by the hole penetrating the cover 714A, but may be provided by a cylindrical member.

The above-described exemplary embodiments and the modifications thereof are merely examples for implementing the present disclosure, and the present disclosure is not limited thereto. It would be obvious for those skilled in the art that various modifications may be made within the scope of the present disclosure.

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" in the specification and claim(s) should be interpreted as "at least one" or "one or more."

What is claimed is:

1. A target supply device comprising:

a tank including a cylindrical main body, a first end portion blocking an axial first end of the main body, and a second end portion blocking an axial second end of the main body;

a nozzle provided to the first end portion of the tank and configured to output a target material contained inside the tank; and an inert gas supply unit configured to supply inert gas into the tank and including a gas flow path in a form of a hole penetrating the second end portion of the tank to guide the inert gas in an inclined direction toward an inner wall of the main body, wherein the inner wall of the main body of the tank partially contacts with the target material, and wherein the second end portion closes the axial second end of the main body except for an opening of the hole, the hole having an inclined portion extending at an angle with respect to the inner wall of the main body to guide the inert gas in the inclined direction towards the inner wall to cause the inert gas to collide against the inner wall.

2. An EUV light generation apparatus comprising:

a tank including a cylindrical main body, a first end portion blocking an axial first end of the main body, and a second end portion blocking an axial second end of the main body;

a nozzle provided to the first end portion of the tank and configured to output a target material contained inside the tank;

an inert gas supply unit configured to supply inert gas into the tank; and a chamber configured to receive laser beam and the target material outputted from the nozzle, wherein the inert gas supply unit includes a gas flow path in a form of a hole penetrating the second end portion of the tank and configured to guide the inert gas in an inclined direction toward an inner wall of the main body, and the tank is fixed to the chamber with an axial direction of the main body being inclined relative to the gravity direction such that the inert gas, a travel direction of which is changed by colliding against the inner wall, obliquely collides against a liquid level of the target material, and wherein the inner wall of the main body of the tank partially contacts with the target material, and wherein the second end portion closes the axial second end of the main body except for an opening of the hole, the hole having an inclined portion extending at an angle with respect to the inner wall of the main body to guide the inert gas in the inclined direction towards the inner wall to cause the inert gas to collide against the inner wall.

3. The target supply device according to claim 1, wherein the inert gas is guided onto the inner wall between the second end portion and a liquid surface of the target material.

4. The target supply device according to claim 1, wherein an opening of the gas flow path faces a liquid surface of the target material.

5. The target supply device according to claim 1, wherein the gas flow path is bent in the second end portion.

6. The target supply device according to claim 1, wherein the inner wall, the first end portion and the second end portion form a containing space for containing the target material in the tank.

7. The EUV light generation apparatus according to claim 2, wherein the inert gas is guided onto the inner wall between the second end portion and a liquid surface of the target material.

8. The EUV light generation apparatus according to claim 2, wherein an opening of the gas flow path faces a liquid surface of the target material.

9. The EUV light generation apparatus according to claim 2, wherein the gas flow path is bent in the second end portion.

10. The EUV light generation apparatus according to claim 2, wherein the inner wall, the first end portion and the second end portion form a containing space for containing the target material in the tank.

11. The target supply device according to claim 1, wherein the second end portion is fixed to the main body by a bolt.

12. The EUV light generation apparatus according to claim 2, wherein the second end portion is fixed to the main body by a bolt.

13. The target supply device according to claim 1, wherein the gas flow path includes a first flow path and a second flow path, and an angle formed between an axis of the first flow path and an axis of the second flow path is in a range from 30 degrees to 60 degrees.

14. The EUV light generation apparatus according to claim 2, wherein the gas flow path includes a first flow path and a second flow path, and an angle formed between an axis of the first flow path and an axis of the second flow path is in a range from 30 degrees to 60 degrees.

* * * * *